US010677460B2

(12) United States Patent
Blais

(10) Patent No.: US 10,677,460 B2
(45) Date of Patent: Jun. 9, 2020

(54) THERMITE BAG FOR CHEMICAL / BIOLOGICAL AGENT MUNITION AND HAZARDOUS WASTE DISPOSAL SYSTEM

(71) Applicant: Southwest Research Institute, San Antonio, TX (US)

(72) Inventor: Matthew S. Blais, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 16/124,051

(22) Filed: Sep. 6, 2018

(65) Prior Publication Data

US 2020/0080722 A1 Mar. 12, 2020

(51) Int. Cl.

| | |
|---|---|
| ***C06B 45/00*** | (2006.01) |
| ***F23G 5/40*** | (2006.01) |
| ***F23G 5/44*** | (2006.01) |
| ***F23Q 3/00*** | (2006.01) |
| *C06B 33/00* | (2006.01) |
| *D03D 23/00* | (2006.01) |
| *D03D 43/00* | (2006.01) |
| *F23G 7/00* | (2006.01) |

(52) U.S. Cl.

CPC ..... *F23G 5/40* (2013.01); *F23G 5/448* (2013.01); *F23Q 3/002* (2013.01); *F23G 7/003* (2013.01); *F23G 2200/00* (2013.01); *F23G 2209/16* (2013.01)

(58) Field of Classification Search

USPC ..... 149/2, 37, 108.4, 108.6, 109.4

See application file for complete search history.

(56) References Cited

U.S. PATENT DOCUMENTS

| | | | | |
|---|---|---|---|---|
| 2,763,209 | A * | 9/1956 | Winer | F41H 13/00 102/322 |
| 3,846,178 | A | 11/1974 | Evjen et al. | |
| 3,888,557 | A | 6/1975 | Anderson et al. | |
| 4,180,177 | A | 12/1979 | Gunderman et al. | |

(Continued)

FOREIGN PATENT DOCUMENTS

| | | |
|---|---|---|
| EP | 2492217 A1 | 8/2012 |
| WO | 9830861 A2 | 7/1998 |

OTHER PUBLICATIONS

Colcase, Colcase Lipo Safe Bag product listing, 2016-2017, (Internet download on Sep. 2, 2018, url: https://www.colcase.com/product/colcase-lipo-safe-bag) 4 Pages.

Baker Aviation, Hot-Stop® 'L' Lithium Ion Fire Containment Kit product brochure, accessed Sep. 2, 2018; https://www.hot-stopl.com/, 4 Pages.

(Continued)

*Primary Examiner* — James E McDonough

(74) *Attorney, Agent, or Firm* — Grossman, Tucker, Perreault & Pfleger, PLLC

(57) ABSTRACT

An aspect of the present disclosure relates to a thermite bag, which may be used for the disposal of hazardous material. The thermite bag includes a sealable exterior pouch, a sealable interior pouch receivable within the exterior pouch, a thermite charge receivable within the sealable interior pouch and an igniter wire contacting thermite within the thermite charge. The thermite bag also includes a power supply electrically coupled to the ignitor wire and a trigger electrically coupled to the ignitor wire and power supply. In addition, the thermite bag includes a vent including a filter, wherein the vent is coupled to the sealable exterior pouch.

24 Claims, 4 Drawing Sheets

(56) References Cited

U.S. PATENT DOCUMENTS

| | | | | |
|---|---|---|---|---|
| 4,328,901 | A | 5/1982 | Gunderman et al. | |
| 4,597,450 | A | 7/1986 | Budmiger | |
| 5,790,963 | A | 8/1998 | Welham | |
| 5,884,569 | A | 3/1999 | Donovan | |
| 5,997,667 | A * | 12/1999 | Jacobson | A62C 99/0054 102/289 |
| 6,173,662 | B1 | 1/2001 | Donovan | |
| 7,204,183 | B2 * | 4/2007 | Cirillo | F42B 39/14 206/3 |
| 7,712,405 | B2 | 5/2010 | Toycen et al. | |
| 8,232,226 | B2 | 7/2012 | Schonfeld et al. | |
| 8,544,670 | B2 * | 10/2013 | Brilmyer | G11B 33/1406 109/33 |
| 9,175,933 | B2 | 11/2015 | Patel | |
| 2002/0056713 | A1 | 5/2002 | Rose | |
| 2006/0234573 | A1 | 10/2006 | Rock | |
| 2009/0178548 | A1 | 7/2009 | Tyas et al. | |
| 2016/0176622 | A1 | 6/2016 | Versteylen S et al. | |

OTHER PUBLICATIONS

Flybag-Der, Fly-Fly-Bag PED Blast Mitigating Container product listing, (Internet download on Aug. 30, 2018, url: http://www.fly-bag.eu/fly-bag-ped-blast-mitigating-container/) 3 Pages.

Flybag-Der, Fly-Bag Cabin Baggage Blast Mitigating Container product listing, (Internet download on Aug. 30, 2018, url: http://www.fly-bag.eu/fly-bag-cabin-baggage-blast-mitigating-container/) 3 Pages.

Newtex Industries, Inc., Z-BLOCK™ Fire Containment Bag product brochure, https://www.newtex.com/nes/fire-containment-bags (Mar. 2017) 2 Pages.

Newtex Industries, Inc., Newtex Z-BLOCK™ Fire and Smoke product lines brochure, https://www.newtex.com/npm/fabrics/z-block-fire-smoke, (Jan. 2018) 2 Pages.

Sporty's Shops, Tablet Fire Containment Bag—from Sporty's Pilot Shop product listing, Internet download Sep. 2, 2018, url: https://www.sportys.com/pilotshop/tablet-fire-containment-bag.html) 2 Pages.

* cited by examiner

THERMITE BAG FOR CHEMICAL / BIOLOGICAL AGENT MUNITION AND HAZARDOUS WASTE DISPOSAL SYSTEM

FIELD

The present disclosure relates to a thermite bag for the disposal of chemical/biological agent munitions and hazardous waste.

BACKGROUND

From time to time, soldiers encounter chemical and biological weapons during operations. These weapons are often disruptive to operations due to the contamination that they pose. In addition, remediation often takes time and great care.

Two commonly used methods of remediating biological and chemical weapon threats include incineration and neutralization. When incineration is employed, the munitions are exposed to temperatures that are preferably high enough to decompose the chemical or biological components of the munitions into ash, water vapor, and carbon dioxide. This may also mitigate any explosive or propellants within a munition. Neutralization chemically alters the agent so that the agent poses a less severe threat than prior to neutralization. Neutralization agents and the resulting byproducts depend on the chemical and biological compositions being treated. These processes may involve one or more steps.

The above processes may be carried out in the field or in mobile labs. For example, larger stock piles may be disposed of in place by bomb drops that incinerate the munitions. However, this method may not be completely effective at destroying all the chemical or biological agents or may be excessive when smaller munition caches are present. Chemical and biological munitions may also be disposed of by neutralization in plants or mobile labs. However, it is often necessary to transport the munitions to the plants or transport the mobile labs to the munitions, which may involve relatively complex operations. Neither of these options may be suitable in situations where soldiers find smaller munition caches during operations. Accordingly, room for improvement remains for a relatively more flexible means of disposing of chemical and biological munitions.

SUMMARY

An aspect of the present disclosure relates to a thermite bag, which may be used for the disposal of hazardous material. The thermite bag preferably includes a sealable exterior pouch, a sealable interior pouch receivable within the exterior pouch, a thermite charge receivable within the sealable interior pouch and an igniter wire contacting thermite within the thermite charge. The thermite bag also preferably includes a power supply electrically coupled to the ignitor wire and a trigger electrically coupled to the ignitor wire and power supply. In addition, the thermite bag preferably includes a vent including a filter, wherein the vent is coupled to the sealable exterior pouch.

Another aspect of the present disclosure relates to a method of disposing of hazardous material. The method preferably includes affixing a thermite charge to hazardous material and positioning the thermite charge and the hazardous material within a sealable interior pouch. The thermite charge includes an igniter including electrical leads extending from the thermite charge and the method further includes affixing a first set of electrical wires to the electrical leads and to a first set of electrical connectors extending through the sealable interior pouch and sealing the sealable interior pouch. The method also preferably includes positioning the interior pouch in a sealable exterior pouch and affixing a second set of electrical wires to the first set of electrical connectors and to a second set of electrical connectors extending through the sealable exterior pouch and sealing the sealable exterior pouch. The method also preferably includes affixing a third set of electrical wires to a power supply and a trigger and activating the thermite charge with the trigger.

Yet another aspect of the present disclosure relates to a kit for providing a thermite bag. The kit preferably includes a thermite charge including an ignitor with electrical leads, a sealable interior pouch defining a first volume therein, configured to receive the thermite charge within the first volume, wherein the thermite charge is sized to be received in the first volume. The kit preferably also includes a first set of electrical wires configured to electrically couple the electrical leads to a first set of electrical connectors in the interior pouch. The kit further preferably includes a sealable exterior pouch defining a second volume therein, configured to receive the sealable interior pouch, wherein the sealable interior pouch is sized to be received within the second volume and a second set of electrical wires configured to electrically couple the first set of electrical connectors to a second set of electrical connectors in the sealable exterior pouch. The kit also preferably includes a third set of electrical wires configured to electrically couple the second set of electrical connectors to a power source and a trigger; and a vent including a filter couplable to the sealable exterior pouch.

BRIEF DESCRIPTION OF THE DRAWINGS

The above-mentioned and other features of this invention and the manner of attaining them will become more apparent with reference to the following description of embodiments herein taking in conjunction with the accompanying drawings, wherein.

DETAILED DESCRIPTION

The present disclosure relates to a thermite bag containing a thermite charge for the disposal of chemical agents, biological agents, or combinations thereof including agents present in munitions or containers. A chemical agent may be understood as herein as a chemical that can injure, incapacitate, or kill human beings and particularly includes those used in a purposeful manner to cause harm. A biological agent may be understood herein as a bacterium, virus, protozoan, parasite, or fungus that can injure, incapacitate, or kill human beings and particularly includes those used in a purposeful manner to cause harm. A thermite charge herein is reference to a composition that is heat activated and undergoes an exothermic reaction, is capable of supplying its own source of oxygen, and can create heat and relatively high temperatures of up to 4000° F.

In addition, the thermite bags may be used to dispose of hazardous waste, including waste contaminated with chemical agents, biological agents or combinations thereof including personal protective equipment, such as boots and gloves. However, other hazardous waste that is eliminated by exposure to elevated temperatures may be treated according to the device and methods discussed herein. The chemical agents, biological agents and hazardous waste are collectively referred to herein as hazardous material. The bag is portable and preferably weighs less than or equal to 6.8 kg (15 pounds), depending on its size. Only one person may be necessary to set up a bag and each bag may be set up in less than 10 minutes. In addition, in non-limiting embodiments, the units may be sewn together and assembled by hand.

Figure 1:
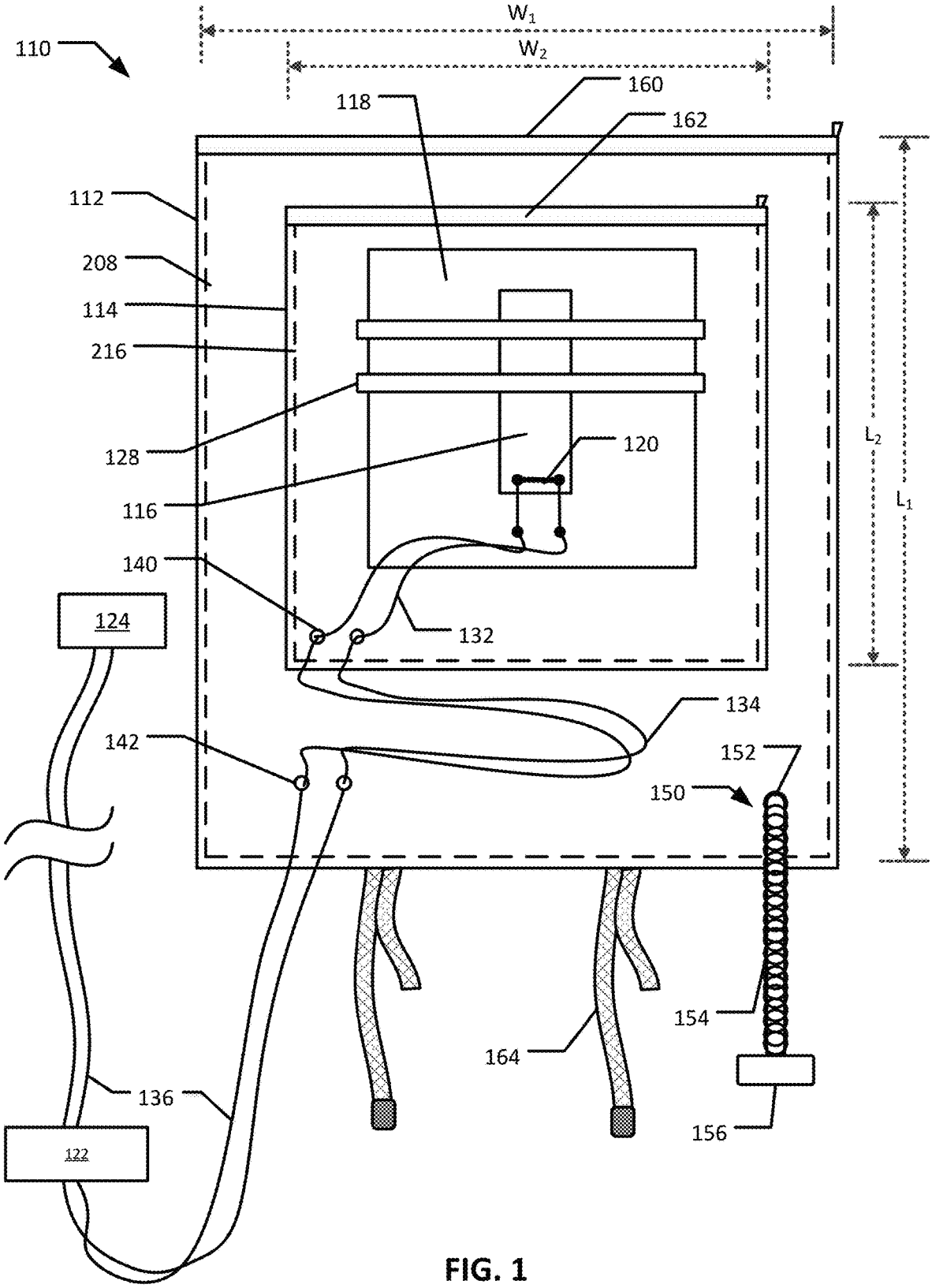
FIG. 1 is a schematic of the thermite bag.

In general, as illustrated in FIG. 1, the thermite bag 110 preferably includes an exterior pouch 112 and an interior pouch 114 placed within the exterior pouch 112. While the term pouch is used herein and often associated with an enclosure including at least two walls as illustrated, the pouch may assume other configurations including more than two walls, such as three to six walls. At least one thermite charge 116 is placed with hazardous material 118 within the interior pouch. The thermite is preferably activated with a fuse 120, such as a squib ignitor, which is electrically coupled to a power source 122 and a trigger 124. The electrical couplings preferably use electrical wires 132, 136, 138 that couple to electrical connectors 140, 142, such as bulkhead fittings, which maintain a gas tight seal in the pouch walls. Further, the exterior pouch preferably includes a filtered vent 150, wherein the vent is fluidly coupled to the exterior pouch, to allow filtered combustion gasses to flow out of the exterior pouch and into the environment, and to prevent the exterior pouch from tearing open. Fluid coupling may be understood as connecting the volumes defined by the exterior pouch and vent in such a manner to allow fluid, including gas, to flow between the exterior pouch and vent. The exterior and interior pouches are preferably sealed by closures including zippers 160, 162; other air-tight and watertight mechanical fasteners; pressure sensitive adhesives, which may be carried by tape; or combinations thereof.

The exterior pouch is preferably sized to allow expansion of the interior pouch upon detonation of the thermite charge. In such embodiments, the exterior pouch exhibits a length $L_1$ that may be 50 percent to 200 percent greater than the length $L_2$ of the interior pouch. In such embodiments, the exterior of the bag exhibits a width $W_1$ that may be 50 percent to 200 percent greater than the width $W_2$ of the interior pouch. Further, in such embodiments, the exterior pouch exhibits a thickness $T_1$ that is the same size as or up to 200 percent greater than the thickness $T_2$ of the interior pouch.

Figure 2:
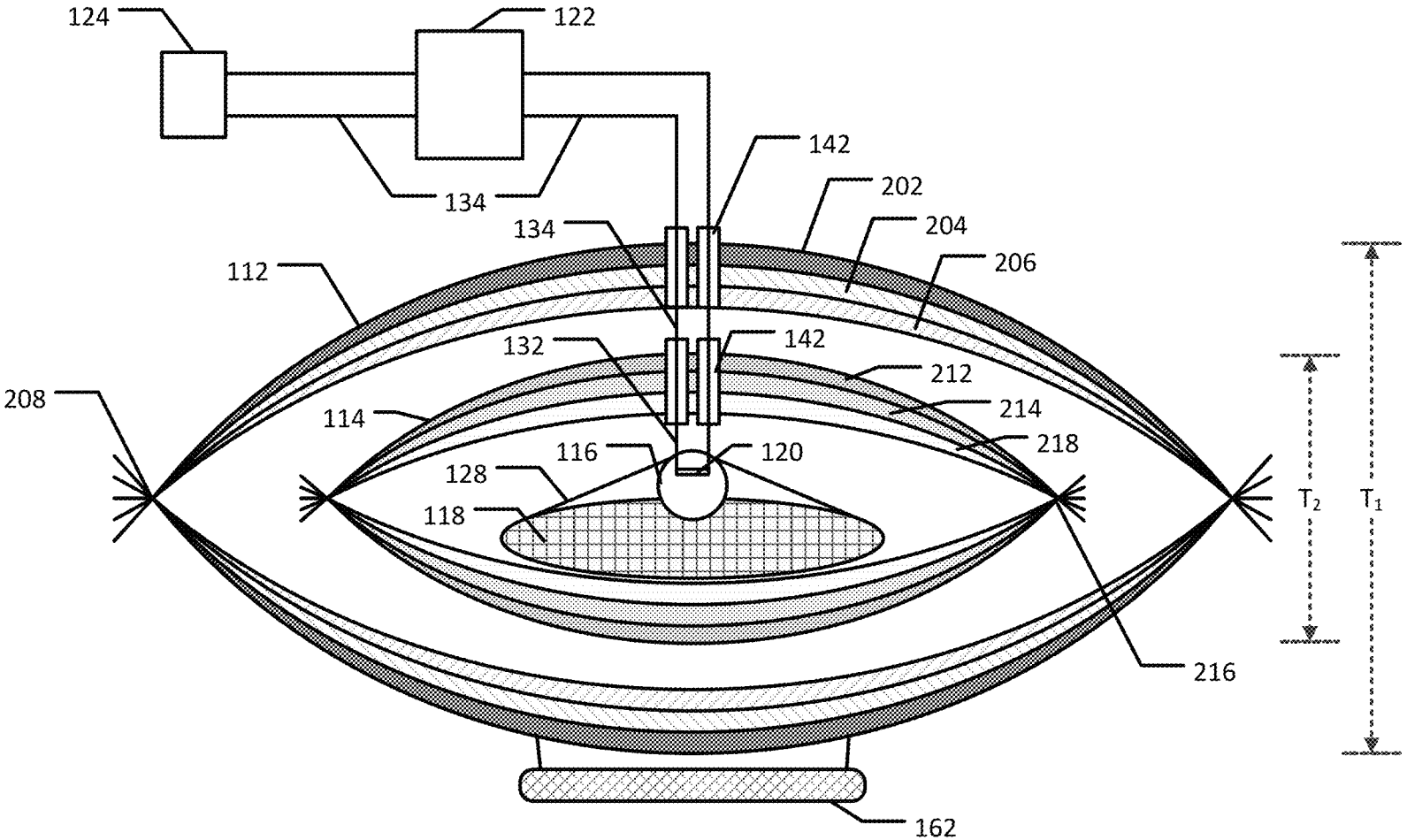
FIG. 2 is a schematic cross-sectional view of the thermite bag.

As illustrated in FIG. 2, the exterior pouch 112 preferably includes at least three layers that define the pouch walls. The pouch walls may be formed from a single sheet including the three layers or from two or more sheets including the three layers. The pouch walls may define a volume therein and an opening defined by at least one of the pouch walls. The exterior pouch is sealable, which may be understood as closable in a manner that prevents the escape of gas or fragments from the pouch.

The innermost layer 206, positioned in the interior of the pouch, is preferably a metallized fabric, such an aluminized fiberglass or an aluminized fiberglass backed fabric, where aluminum foil is affixed to the fiberglass. The metallized fabric is preferably capable of withstanding exposure to temperatures of up to 4000° F. and preferably in the range of 350° F. to 4000° F., and more preferably in the range of 1,200+/−100° C. in accordance with the following standards NFPA 1971, ISO 17492 and ISO 17493. The fabric of the aluminized fiberglass backed fabric preferably includes a high temperature material formed from, for example, aramids such as para- or meta-aramids, rayon, oxidized polyacrylonitrile fiber, and blends thereof, including those, for example, available under the tradenames NOMEX, TWARON, or KEVLAR. The metallized fabrics may be available from, e.g., NEWTEX, Victor, N.Y. under the tradenames ZETEX, Z-FLEX, and Z-TECH.

The middle layer 204, positioned between the innermost and outer layer, may be formed from carbon filtration media to capture hazardous material that may escape the inner bag. The carbon filtration media is preferably provided by a filter fabric including activated carbon fixed onto a textile carrier fabric, such as nylon or rayon. The textile carrier fabric may include one or more natural fibers such as cotton or cellulose; one or more synthetic fibers such as aramid, polyamide, rayon, oxidized polyacrylonitrile; or a combination of one or more natural and synthetic fibers. The fabric preferably exhibits a carbon density of between 180 grams per square meter to 220 grams per square meter, including all values and ranges therein. The carbon is preferably spherical in form; however, other forms may be acceptable as well, such as fibers, nanotubes or particles. In addition, the carbon preferably exhibits a specific surface area, as measured by the BET method, in the range of 500 $m^2/g$ to 2000 $m^2/g$, including all values and ranges therein and preferably 750 $m^2/g$ to 1500 $m^2/g$. The carbon may be adhered to the fabric using an adhesive, which may be applied to the surfaces of the textile carrier fabric or impregnated in the fibers. In particularly preferred embodiments, the material is the same or similar to the material specified in the JSLSIT suit filtration layer. The carbon filtration media may be available from, e.g., BLUCHER, Germany.

The outer layer 202 of the exterior pouch is preferably formed of a textile material, including natural fibers, synthetic fibers, or a combination thereof. In preferred embodiments, the outer layer of the exterior pouch is formed from a blend of cotton and nylon and in particularly preferred embodiments, the blends include 25% to 75% cotton and 25% to 75% nylon, provided to achieve a total of 100%, including all values and ranges therein, such as 50% cotton to 50% nylon.

The layers may be formed into one or more sheets and sewn together into a pouch or bag using thread 208, which is preferably formed from aramid fiber, such as para- or meta-aramid fiber including KEVLAR, NOMEX or TWARON, rayon, cotton, or blends thereof. Alternatively, or in addition, an adhesive may be used to seal the edges of the pouch together. As noted, an opening is defined by at least one of the pouch walls and the opening is preferably closed by a zipper (as illustrated in FIG. 1) affixed to the pouch wall. In preferred embodiments a zipper includes tape formed from materials such as aramid, polyamide, oxidized polyaramide, and the teeth are formed from materials that withstand temperatures of at least 750° F., such as in the range of 750° F. to 1500° F. Nonlimiting examples include airtight and water tight zippers from YKK or from ITW of Glenville, Ill., which sells MAXIGRIP zippers. However, it may be appreciated that the pouch may also be closed by a pressure sensitive adhesive or other mechanical closure. Preferably, the closure is water tight and air tight, preventing the passage of water and air through the zipper when closed.

The interior pouch 114 is preferably constructed from at least two layers 212, 214 of the aluminized fabrics or aluminized fiberglass backed fabrics described above. The layers of fabric may be formed into one or more sheets and sewn together to provide the pouch. The pouch walls define a volume therein and an opening is defined by at least one of the pouch walls. The interior pouch is also sealable to prevent the escape of gas or fragments in the pouch.

Again, these layers may be sewn together to provide a pouch using stitching 216, with thread, or adhesive, as described above with respect to the exterior pouch. In addition, at least one layer of mineral wool 218 is optionally, but preferably, provided over the charge 116 and hazardous material 118. For example, the charge and hazardous material may be wrapped in mineral wool, which may be provided in one or more layers and up to ten layers. In one embodiment, the mineral wool may be affixed to the inside of the interior pouch. In preferred embodiments, one sheet of mineral wool is placed on each side of the charge and hazardous material inside the interior pouch. The mineral wool preferably exhibits a thickness in the range of 5 mm to 50 mm, including all values and ranges therein and is more preferably 20 mm to 25 mm. Like the exterior pouch, the interior pouch is sealable with a closure such as a zipper or a pressure sensitive adhesive. Preferably, the closure is water tight and air tight. Zippers are preferably used and formed from materials that may withstand elevated temperatures of at least 750° F., such as those described above.

The thermite charge 116 is identified as thermite composition 302 (see FIG. 3) and is preferably provided by two components such as a metal (e.g., iron) and an oxidizer [e.g. potassium perchlorate ($KClO_4^-$)] which provide sufficient energy, over a relatively short period of time, with relatively low gas generation. Such gas generation may be in the range of 4-10 cubic meters, more preferably 4-7 cubic meters, depending upon the size of the bag. The metal (e.g. iron) is preferably present at a weight percent of the total weight of the iron and potassium perchlorate in the range of 45 to 50% wt., including all values and ranges therein, and the oxidizer (e.g., potassium chlorate) is preferably present at a weight percent of the total weight of the iron and potassium perchlorate in the range of 50 to 55% wt., including all values and ranges therein. Alternatively, other fuel combinations may be used to form the thermite charge including but not limited to the use of aluminum (Al) or titanium (Ti) with an oxidizer. The oxidizer may preferably be periodate ($IO_4^-$ or $IO_6^-$) or potassium ferrate ($K_2FeO_4$).

The thermite charge compounds are preferably provided at a total weight in the range of up to 2 kg of thermite, including all values and ranges from 100 grams to 2 kilograms of thermite. However, depending on the size of the bag, the charge sizes may vary and may be larger or smaller. The thermite charge is preferably provided in a container 304, such as a plastic bottle wherein the plastic may be formed from a thermoplastic, e.g., a styrene butadiene co-polymer. The container 304 may include a cap 308 that is mechanically fastened to the body 306 of the container, by e.g., a press fit or threads. The thermite charge may be affixed to the hazardous material by sealing the charge in the interior pouch with the hazardous waste. Additionally, a chemical or mechanical fastener 128 such as, e.g., tape, rope, twine, string, or wire, may be used to attach the thermite charge to the hazardous waste.

Figure 3:
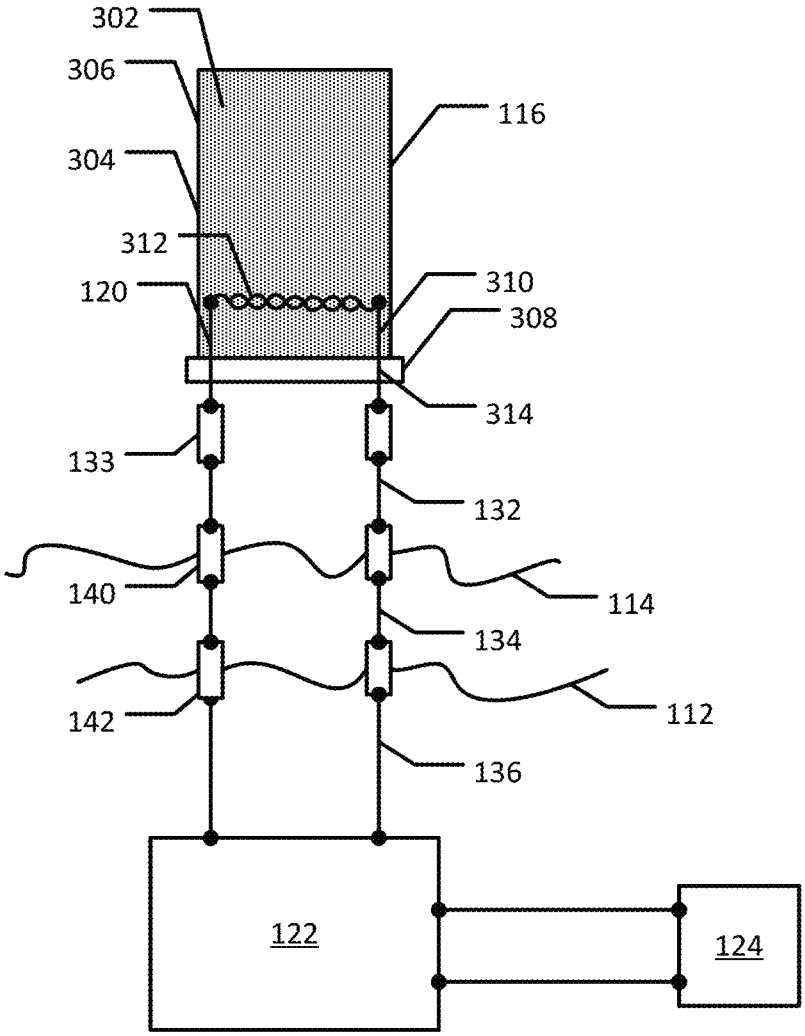
FIG. 3 is a schematic of the electrical system for the thermite bag.

As alluded to above, and illustrated further in FIG. 3, the composition 302 that defines the thermite charge 116 is preferably ignited by an ignitor 120, which is preferably formed from a resistive wire 310 inserted into the thermite container 116. In preferred embodiments, the ignitor wire is preferably a 22-gauge Ni/Cr wire formed into a 2 mm diameter coil 312 of 8 turns. It may be appreciated, however, that other wire materials may be utilized exhibiting different gauge sizes and conductive metals or alloys. Further, the coil diameter may be in the range of 0.5 mm to 10 mm, including all values and ranges therein and the coil may include 1 to 30 turns, including all values and ranges therein. The wire preferably exhibits an electrical resistance, at a room temperature (20° C. to 24° C.) in the range of 1.1 to 3.0Ω per foot, including all values and ranges therein. In embodiments, a AN-M14 TH3 grenade may be used as the thermite charge when fit with an electrical igniter.

The igniter wire leads 314 extend through the wall of the charge container, such as through the container cap, as illustrated, and are preferably electrically coupled to a power source and a trigger by at least one, or more, electrical connections. For example, a first set of electrical wires 132 may be clamped to the ignitor leads via clips 133, such as alligator or spring clips. The first set of electrical wires 132 are preferably coupled to a first set of electrical connectors 140 extending through a wall of the interior pouch. The first set of electrical wires are preferably long enough that the wires may extend out of the interior pouch and may be up to 1 meter in length. A second set of electrical wires 134 may couple the first set of electrical connectors 140 to second set of electrical connectors 142 extending through a wall of the exterior pouch. The second set of wires may be longer than the first set of wires and up to 2 meters in length. The second set of electrical connectors are coupled to a third set of wires 136 that are attached to the power source 122 and trigger 124. The third set of wires may be sufficiently long to allow the bag to be displaced at least 50 feet from the personnel activating the bag trigger. The electrical connectors are preferably bulkhead (or tank) connectors, but may be any connectors that maintain a seal in the wall. The power source may optionally remain within a few feet of the bag. The power source is preferably provided by an AC power source of 110 V or higher, such as 240 V, or a 12 V DC battery. The electrical connectors are preferably formed from a metal, a metal alloy, glass, ceramic, a high temperature polymer material or a combination thereof. The polymer material may include materials such as polyether ether ketone or polyetherimide. The fittings are preferably sealed with a high temperature sealant, which exhibits a heat resistance of up to 700° F., and more preferably up to 4,000° F. including all values and ranges therein, such as 700° F. to 1,500° F.

As the interior pouch will likely rupture due to gas generation from the thermite charge and by-products of the hazardous materials, a vent 150 (as illustrated in FIG. 1) is provided in the exterior pouch to prevent the exterior pouch from rupturing by relieving pressure that may build in the volume of the exterior pouch. The vent is preferably affixed to the bag via a connector 152, and optionally washers, and sealed with a high temperature sealant, which exhibits a heat resistance of up to 700° F., and more preferably up to 4,000° F. The connector 152 is preferably a bulkhead connector. The vent may also include a flexible hose 154 coupled to a cartridge filter 156; however, it may be appreciated that in embodiments, the cartridge filter 156 may be connected directly to the connector 152. The flexible hose is preferably formed from metal or metal alloys, such as anodized steel as used in electrical conduit. Alternatively, a fabric hose coated both internally and externally with polytetrafluoroethylene may be employed. Preferably, the cartridge filter removes at least 99 percent of particles 0.3 μm or greater and more preferably removes 99.9 percent of particles 0.3 μm or greater, which may be classified as a P100 filter. The pressure drop across the filter may be in the range of 1 to 4 inches of water, including all values and ranges therein. The filter may rely on carbon as a filtration media, including one or more of activated carbon and treated carbon, to absorb or react with liquid vapors and gasses. The filter is preferably affixed to the flexible hose by a mechanical fastener, such as threads. In embodiments, the cartridge filters may be selected from those already provided for, e.g., the M40 mask.

The bag may be rolled to improve packability and secured in the rolled configuration using straps 164, which may be formed from natural or synthetic fibers, including any of the fibers noted above. The straps may be sewn to the bag 100 and affixed together using mechanical fasteners, such as buckles. As illustrated in FIG. 2, a handle 162 may also be provided on the exterior of the bag and may be formed from the same material as the straps.

The various components described above may be provided in a kit, that is either self-contained, i.e., all the components are provided within the exterior pouch, or the components may be provided in another bag, to prevent the aluminum of the fabrics from cracking or tearing from the weight of the other components of the system.

In a non-limiting preferred embodiment, the external bag dimensions are 2 meters long, 1.3 meters wide and 0.5 inches thick and the interior pouch dimensions are 0.6 meters long by 0.6 meters wide and 0.5 inches thick. Further, the bag may weigh less than 15 pounds. The bag, constructed in the dimensions described above, using aluminized oxidized para aramid fabric, such as ALUMAX, available from AB Technology Group, as the heat resistant fabric, at least one one-inch sheet of mineral wool on either side of the charge and hazardous material, and a 2 kg charge of iron/potassium perchlorate thermite, provided successful results against 0.5 liter simulants for venomous agent "X" (VX) and tris(1,3-dichloroisopropyl)phosphate (TDCPP) in both plastic and relatively thin walled metal containers.

Such bags may be easily deployed and may accommodate up to 4 liters of hazardous material, preferably 1 if not two containers of hazardous material up to the size of a 4.2-inch (107 mm) mortar, and 2 kg of thermite charge. The thermite bag can be made by hand with an upholstery sewing machine; however, other methods may be used to assemble the bags.

Figure 4:
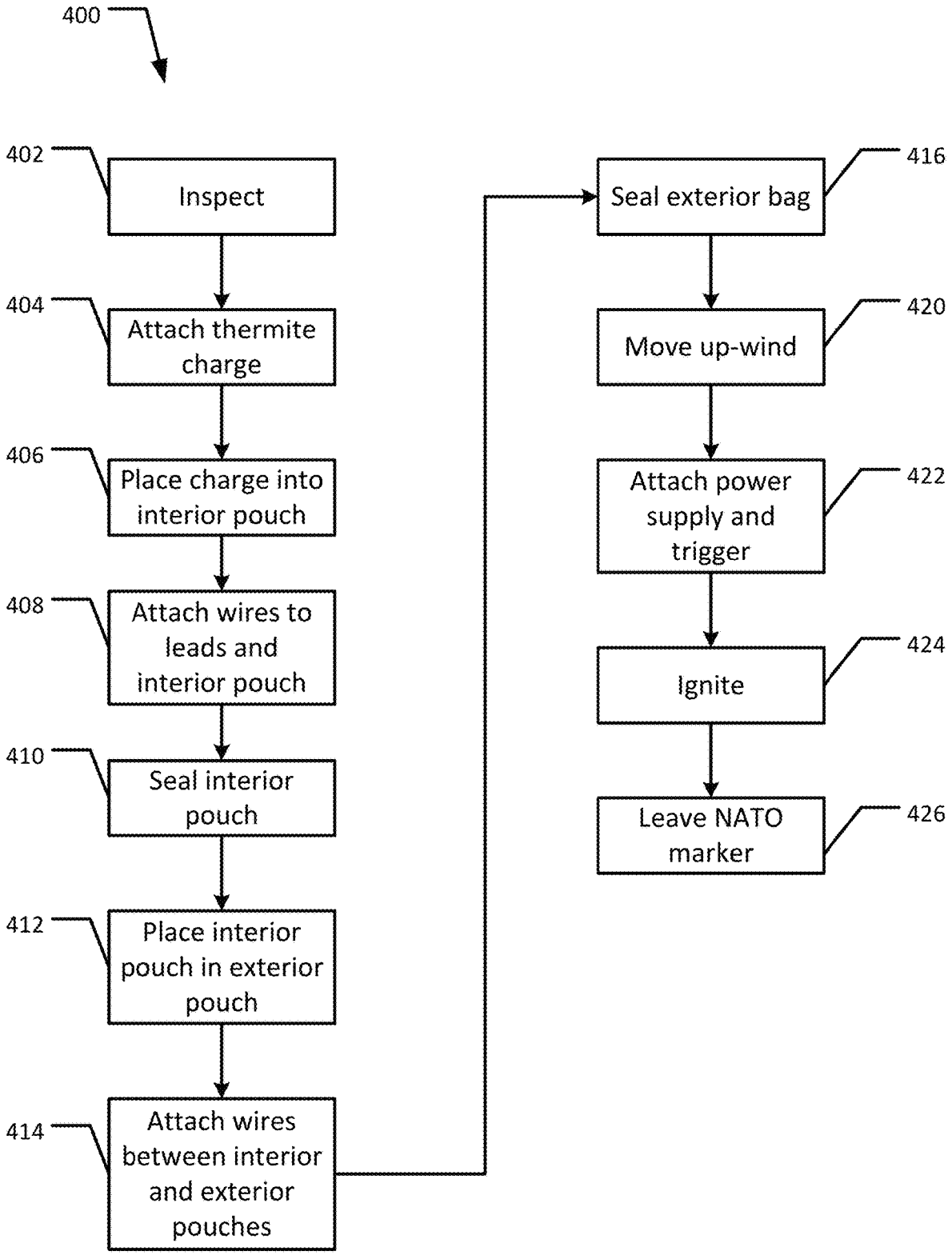
FIG. 4 is a flow chart of an embodiment of a method for deploying the bag.

The system may be deployed according to the method 400 illustrated in FIG. 4. First the hazardous materials may be inspected 402 to determine if it is possible to handle the hazardous materials and whether the hazardous materials can be moved. Depending on the size of the hazardous material, one or two pieces of material may be attached to a thermite charge 404. The hazardous material and thermite charge may then be placed in the bag 406 with a layer of mineral wool positioned around the hazardous material and thermite charge in the interior pouch. Electrical wires may then be attached to the electrical leads of the ignitor 408. The interior pouch may then be sealed 410 after forcing the air out of the bag, gently. The interior pouch may then be placed into the exterior pouch 412. Electrical connections between the interior pouch and exterior pouch, if not already made, may then be made 414. The air may then be forced, gently, out of the exterior pouch and the bag may be sealed 416. The electrical connections between the exterior pouch and the power source may then be made 418. Personnel should then walk or otherwise position themselves upwind, preferably in the range of 50 to 100 feet or more 420 and the trigger may be attached to the power supply and bag 422. Then the thermite may be ignited 424 and the reaction should take 0.5 seconds to 15.0 seconds, more preferably 3.0 seconds to 10 seconds, and most preferably 3.0 seconds to 5.0 seconds. Optionally, the bag may then be marked with a NATO marker 426.

It is understood that the thermite charge is capable of breaching munitions and containers as well as thermally decomposing chemical or biological agents. For example, the relatively high temperatures and available energy of the thermite may induce uni-molecular decomposition of sarin (GB) and venomous agent "X" (VX) via the retro-ene reaction. The breakdown products for GB and VX further decompose the agent via an acidic catalyzed hydrolysis mechanism. Sulfur mustard (HD) decomposes via a relatively more complicated series of mechanisms that produce a relatively complicated mixture of products.

As noted, preferably, the reaction within the bag is contained for 3 to 10 seconds, to allow for heat soaking of the contaminated materials to improve decontamination. One personnel may complete this process in less than 10 minutes and may accommodate up to two rounds of munition per bag (depending on size, as noted above). It is estimated that a team of 6 may eliminate 48 rounds in 40 minutes with 24 bags, which each team member carrying 60 pounds of extra equipment, or four bags a piece. The bags are preferably abandoned in place and appropriately marked. The thermite bag herein is contemplated to destroy greater than 90% of chemical agent and render munitions non-mission-capable, i.e., unusable for being deployed. Residue is understood to continue to decompose over time.

As noted, the thermite bag may be used to dispose of chemical or biological agents, for example, chemical munitions or container, biological munitions or containers, personal protective equipment, clothing and combinations thereof. Personal protective equipment may include, for example, boots, gloves, safety glasses, coveralls, body suits, vests, masks, earplugs, ear muffs and hard hats, which may be provided pre-bagged or loose.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A thermite bag, comprising:

a sealable exterior pouch;

a sealable interior pouch receivable within said exterior pouch;

a thermite charge receivable within said sealable interior pouch;

an igniter wire contacting thermite within said thermite charge;

a power supply electrically coupled to the ignitor wire;

a trigger electrically coupled to the ignitor wire and power supply;

a vent including a filter, wherein said vent is fluidly coupled to said exterior pouch; and wherein a hazardous material is positioned within a first volume defined by said sealable interior pouch with said thermite charge affixed to said hazardous material and said sealable interior pouch is positioned within a second volume defined by said sealable exterior pouch.

2. The thermite bag of claim 1, wherein said sealable exterior pouch comprises:

an outer layer including a textile material;

an inner layer including a metallized fabric; and a middle layer, between the outer layer and inner layer, including a carbon filtration media.

3. The thermite bag of claim 2, wherein said metallized fabric comprises at least one of fiberglass, aramid fiber, rayon and oxidized polyacrylonitrile fiber.

4. The thermite bag of claim 3, wherein said carbon filtration media comprises activated carbon affixed to a textile carrier fabric, wherein said activated carbon exhibits a specific surface area, as measured by the BET method, in the range of 500 $m^2/g$ to 2000 $m^2/g$.

5. The thermite bag of claim 1, wherein said sealable interior pouch comprises:

at least two layers of a metallized fabric.

6. The thermite bag of claim 1, further comprising mineral wool receivable in said sealable interior pouch.

7. The thermite bag of claim 1, wherein said ignitor includes a resistive wire including electrical leads extending from said thermite charge and a first set of electrical wires connected to said electrical leads, said first set of electrical wires coupled to a first set of electrical connectors in said interior pouch wall, a second set of electrical wires coupled to said first set of electrical connectors and a second set of electrical connectors in said exterior pouch wall, and a third set of wires coupled to said power supply and said trigger.

8. The thermite bag of claim 7, further comprising at least one of spring clips or alligator clips for connecting said electrical wires to said electrical leads.

9. The thermite bag of claim 1, wherein said sealable interior pouch includes an opening defined by at least one wall of said sealable interior pouch and a zipper coupled to said at least one wall for sealing said interior pouch.

10. The thermite bag of claim 1, wherein said sealable exterior pouch includes an opening defined by at least one wall of said exterior pouch and a zipper coupled to said at least one wall for sealing said sealable exterior pouch.

11. The thermite bag of claim 1, wherein said power source is selected from a 12-volt DC battery and AC power source having a voltage of at least 110 volts.

12. The thermite bag of claim 1, wherein said filter is a carbon filter.

13. The thermite bag of claim 1, wherein said vent includes a hose coupled to said filter and said sealable exterior pouch.

14. The thermite bag of claim 1, wherein said thermite charge is heat activated and provides a temperature of up to 4000° F. over a period of 0.5 seconds to 15.0 seconds.

15. The thermite bag of claim 14 wherein said thermite charge comprises a metal and an oxidizer.

16. A method of disposing of hazardous material, comprising:

affixing a thermite charge to hazardous material;

positioning said thermite charge and said hazardous material within a sealable interior pouch, wherein said thermite charge includes an igniter including electrical leads extending from said thermite charge;

affixing a first set of electrical wires to said electrical leads and to a first set of electrical connectors extending through said sealable interior pouch;

sealing said sealable interior pouch;

positioning said interior pouch in a sealable exterior pouch and affixing a second set of electrical wires to said first set of electrical connectors and to a second set of electrical connectors extending through said sealable exterior pouch;

sealing said sealable exterior pouch;

affixing a third set of electrical wires to a power supply and a trigger;

activating said thermite charge with said trigger.

17. The method of claim 16, further comprising positioning mineral wool around said thermite charge and hazardous material within said sealable interior pouch.

18. The method of claim 16, wherein said sealable interior pouch is sealed by zipping a zipper and said sealable exterior pouch is sealed by zipping a zipper.

19. A kit for providing a thermite bag, comprising:

a thermite charge including an ignitor with electrical leads;

a sealable interior pouch defining a first volume therein, configured to receive said thermite charge within said first volume, wherein said thermite charge is sized to be received in said first volume;

a first set of electrical wires configured to electrically couple said electrical leads to a first set of electrical connectors in said interior pouch;

a sealable exterior pouch defining a second volume therein, configured to receive said sealable interior pouch, wherein said sealable interior pouch is sized to be received within said second volume, a second set of electrical wires configured to electrically couple said first set of electrical connectors to a second set of electrical connectors in said sealable exterior pouch;

a third set of electrical wires configured to electrically couple said second set of electrical connectors to a power source and a trigger;

a vent including a filter couplable to said sealable exterior pouch; and further comprising mineral wool for positioning between said thermite charge and said interior pouch.

20. A thermite bag, comprising:

a sealable exterior pouch;

a sealable interior pouch receivable within said exterior pouch;

a thermite charge receivable within said sealable interior pouch;

an igniter wire contacting thermite within said thermite charge;

a power supply electrically coupled to the ignitor wire;

a trigger electrically coupled to the ignitor wire and power supply; and a vent including a carbon filter, wherein said vent is fluidly coupled to said exterior pouch.

21. A thermite bag, comprising:

a sealable exterior pouch;

a sealable interior pouch receivable within said exterior pouch;

a thermite charge receivable within said sealable interior pouch;

an igniter wire contacting thermite within said thermite charge;

a power supply electrically coupled to the ignitor wire;

a trigger electrically coupled to the ignitor wire and power supply; and a vent including a filter, wherein said vent is fluidly coupled to said exterior pouch wherein said sealable interior pouch comprises at least two layers of a metallized fabric.

22. A thermite bag, comprising:

a sealable exterior pouch;

a sealable interior pouch receivable within said exterior pouch;

a thermite charge receivable within said sealable interior pouch;

an igniter wire contacting thermite within said thermite charge;

a power supply electrically coupled to the ignitor wire;

a trigger electrically coupled to the ignitor wire and power supply; and a vent including a filter, wherein said vent is fluidly coupled to said exterior pouch further comprising mineral wool receivable in said sealable interior pouch.

23. A thermite bag, comprising:

a sealable exterior pouch;

a sealable interior pouch receivable within said exterior pouch;

a thermite charge receivable within said sealable interior pouch;

an igniter wire contacting thermite within said thermite charge;

a power supply electrically coupled to the ignitor wire;

a trigger electrically coupled to the ignitor wire and power supply;

a vent including a filter, wherein said vent is fluidly coupled to said exterior pouch wherein said sealable exterior pouch comprises:

an outer layer including a textile material;

an inner layer including a metallized fabric; and a middle layer, between the outer layer and inner layer, including a carbon filtration media.

24. A thermite bag, comprising:

a sealable exterior pouch;

a sealable interior pouch receivable within said exterior pouch;

a thermite charge receivable within said sealable interior pouch;

an igniter wire contacting thermite within said thermite charge;

a power supply electrically coupled to the ignitor wire;

a trigger electrically coupled to the ignitor wire and power supply; and a vent including a filter, wherein said vent is fluidly coupled to said exterior pouch wherein said sealable interior pouch comprises at least two layers of a metallized fabric.

* * * * *